US008523016B2

(12) United States Patent
Teys

(10) Patent No.: US 8,523,016 B2
(45) Date of Patent: Sep. 3, 2013

(54) DISPENSING CONTAINER

(75) Inventor: Bradley Donald Teys, Shelly Beach (AU)

(73) Assignee: Sands Innovations Pty Ltd., Brisbane (AU)

( * ) Notice: Subject to any disclaimer, the term of this patent is extended or adjusted under 35 U.S.C. 154(b) by 0 days.

(21) Appl. No.: 13/133,641

(22) PCT Filed: Dec. 9, 2008

(86) PCT No.: PCT/AU2008/001809
§ 371 (c)(1),
(2), (4) Date: Aug. 22, 2011

(87) PCT Pub. No.: WO2010/065980
PCT Pub. Date: Jun. 17, 2010

(65) Prior Publication Data
US 2011/0290800 A1 Dec. 1, 2011

(51) Int. Cl.
*B65D 35/00* (2006.01)

(52) U.S. Cl.
USPC ..... 222/107; 222/541.5

(58) Field of Classification Search
USPC ..... 222/107, 106, 556, 541.1, 541.4–541.6, 222/206, 215; 206/469–471, 820, 824; 220/780, 265, 266, 276, 259.1, 259.2
See application file for complete search history.

(56) References Cited

U.S. PATENT DOCUMENTS

| | | | |
|---|---|---|---|
| 1,000,178 | A | 8/1911 | Kahl |
| 1,372,325 | A | 3/1921 | Willemin |
| 1,754,973 | A | 4/1930 | Walch |
| 2,654,252 | A | 10/1953 | Davis |
| 2,837,822 | A | 6/1958 | Wille |
| 3,036,700 | A | 5/1962 | Krug |
| 3,075,639 | A | 1/1963 | Lingley |
| 3,116,152 | A | 12/1963 | Smith |
| 3,133,679 | A | 5/1964 | Brown |
| 3,154,418 | A | 10/1964 | Lovell |
| D209,953 | S | 1/1968 | Stehl |
| 3,521,805 | A | 7/1968 | Ward |

(Continued)

FOREIGN PATENT DOCUMENTS

| | | |
|---|---|---|
| AU | 63787/98 | 11/1998 |
| AU | 1999 47456 | 2/2000 |

(Continued)

OTHER PUBLICATIONS

International Search Report, dated Apr. 6, 2009, from corresponding International Application No. PCT/AU2008/001809, filed Dec. 9, 2008 (5 pages).

(Continued)

*Primary Examiner* — Lien Ngo
(74) *Attorney, Agent, or Firm* — Fitch, Even, Tabin & Flannery, LLP

(57) ABSTRACT

A container having a body, the body defining a cavity for storing dispensable cavity contents and having an opening, a covering for covering said opening; and a lid connected to the body by a failure zone and openable, in use, after failure of the failure zone, about a hinge formed by the covering. The lid may have a re-closable arrangement, the covering may be hinged with the container and may include strengthening ribs. The body may also have multiple cavities and multiple lids.

29 Claims, 10 Drawing Sheets

(56) References Cited

U.S. PATENT DOCUMENTS 3,410,457 A 11/1968 Brown
3,421,654 A 1/1969 Hexel
3,428,460 A 2/1969 Ely
D216,306 S 12/1969 Dutch
3,620,676 A 2/1971 Davis
3,581,885 A * 6/1971 Wald ..... 206/470
3,618,751 A 11/1971 Rich
3,635,376 A 1/1972 Hellstrom
3,648,369 A 3/1972 Frodsham
3,741,384 A 6/1973 Cloud
3,756,386 A 9/1973 Marckardt
3,776,375 A 12/1973 Rohdin
3,835,995 A 9/1974 Haines
3,872,970 A 3/1975 Edison
3,891,331 A 6/1975 Avery
3,911,578 A 10/1975 Ushkow et al.
3,913,734 A 10/1975 Siegel
3,921,805 A 11/1975 Compere
3,946,652 A 3/1976 Gorin
3,948,394 A 4/1976 Hellstrom
3,986,640 A 10/1976 Redmond
4,005,776 A 2/1977 Seeley
4,011,949 A 3/1977 Braber et al.
4,106,621 A 8/1978 Sorenson
4,155,454 A 5/1979 Ryden
4,218,155 A 8/1980 Weidner
4,231,496 A 11/1980 Gilson
4,236,652 A 12/1980 Beguhn
4,266,667 A 5/1981 Ishigaki
D259,533 S 6/1981 Frodsham
4,275,646 A 6/1981 Barna
4,277,194 A 7/1981 Smith
D263,074 S 2/1982 Mason
4,317,284 A 3/1982 Prindle
4,331,255 A 5/1982 Fournier
4,338,338 A 7/1982 Popkes
4,341,302 A 7/1982 Baker et al.
4,387,809 A 6/1983 Botzler
D275,517 S 9/1984 Hamilton et al.
4,493,574 A 1/1985 Redmond et al.
4,499,353 A * 2/1985 Shields ..... 206/470
D281,719 S 12/1985 Holewinski et al.
D281,813 S 12/1985 Holewinski et al.
4,580,587 A 4/1986 Rittich et al.
4,602,719 A 7/1986 Borst
4,611,715 A 9/1986 Redmond
4,615,120 A 10/1986 Newman
4,655,627 A 4/1987 Bradley
4,687,129 A * 8/1987 Cugley ..... 220/315
4,724,982 A 2/1988 Redmond
4,784,268 A 11/1988 Perchak
4,790,429 A 12/1988 Fukushima
4,830,222 A 5/1989 Read
4,841,637 A 6/1989 Scholzen
4,871,091 A 10/1989 Preziosi
4,888,188 A 12/1989 Castner, Sr. et al.
4,891,232 A 1/1990 Dahl
4,921,137 A 5/1990 Heijenga
4,922,611 A 5/1990 Levy
4,938,462 A 7/1990 Gould
5,009,894 A 4/1991 Hsaio
5,027,947 A 7/1991 Reighart
5,048,715 A 9/1991 Wolff
5,067,822 A 11/1991 Wirth et al.
5,105,603 A 4/1992 Natterer
D327,013 S 6/1992 Reighart
5,119,560 A 6/1992 Noble
5,125,528 A 6/1992 Heyn et al.
5,125,534 A 6/1992 Rose et al.
RE34,087 E 10/1992 Redmond
D330,481 S 10/1992 Green
5,154,293 A 10/1992 Gould
5,154,318 A 10/1992 Lampard
5,158,192 A 10/1992 Lataix
D334,058 S 3/1993 Noble
5,203,459 A 4/1993 Wade
5,209,354 A * 5/1993 Thornhill et al. ..... 206/469
5,215,221 A 6/1993 Dirksing
5,238,157 A 8/1993 Gentile
5,238,179 A 8/1993 Hart
5,240,415 A 8/1993 Haynie
D340,408 S 10/1993 Hirsch
5,251,758 A 10/1993 Kolacek
5,277,103 A 1/1994 Cox
D344,058 S 2/1994 Jones
5,305,928 A 4/1994 Verdaguer
D347,277 S 5/1994 Snedden
5,308,008 A 5/1994 Ruegg
5,348,191 A 9/1994 Dekeyser
5,377,879 A 1/1995 Isaacs
5,392,945 A 2/1995 Syrek
5,395,031 A 3/1995 Redmond
5,398,908 A 3/1995 Kienle
5,408,804 A 4/1995 Schroder
5,409,125 A 4/1995 Kimber et al.
D358,466 S 5/1995 Harris et al.
5,411,178 A 5/1995 Roders et al.
5,426,919 A 6/1995 Natterer et al.
5,431,357 A 7/1995 Ruegg
5,437,881 A 8/1995 Jeannin
5,440,976 A 8/1995 Giuliano et al.
D362,304 S 9/1995 Wilson et al.
5,464,595 A 11/1995 Finnah
5,477,660 A 12/1995 Smith
5,491,895 A 2/1996 Lee
5,494,192 A 2/1996 Redmond
5,494,252 A 2/1996 Amit et al.
5,529,224 A 6/1996 Chan et al.
D371,491 S 7/1996 Stein
5,553,805 A 9/1996 Ruegg
D375,055 S 10/1996 Reed
5,564,569 A 10/1996 Kiefer
D375,352 S 11/1996 Bologna
D375,353 S 11/1996 Wolf
5,577,627 A 11/1996 Richie-Dubler
5,579,957 A 12/1996 Gentile et al.
5,582,330 A 12/1996 Iba
RE35,437 E 2/1997 Ascone
5,676,244 A 10/1997 Green et al.
5,676,280 A 10/1997 Robinson
5,676,990 A 10/1997 Wawrzynski
5,695,084 A 12/1997 Chmela et al.
5,705,212 A 1/1998 Atkinson
5,706,980 A 1/1998 Dickerson
5,792,496 A 8/1998 Fekete et al.
D398,843 S 9/1998 Wiegner
5,826,737 A 10/1998 Zakensberg
5,827,535 A 10/1998 Stone
5,839,609 A 11/1998 Zakensberg
D402,546 S 12/1998 Massing
D403,512 S 1/1999 Hennings
5,873,167 A 2/1999 Mason
5,873,483 A 2/1999 Gortz et al.
5,875,914 A 3/1999 Nguyen et al.
D407,640 S 4/1999 Nelson et al.
D408,217 S 4/1999 LoGiudice
D408,278 S 4/1999 Konop
5,944,516 A 8/1999 Deshaies
5,975,305 A 11/1999 Barger
5,979,657 A 11/1999 Bumbera
6,003,673 A 12/1999 Vieu
6,003,710 A 12/1999 Huang
6,006,505 A 12/1999 Natterer
6,007,246 A 12/1999 Kinigakis et al.
D419,063 S 1/2000 Baker et al.
6,024,219 A 2/2000 Froehlich et al.
6,041,930 A 3/2000 Cockburn
D422,851 S 4/2000 Joergensen
D425,617 S 5/2000 Snedden
6,062,413 A 5/2000 Redmond
D426,708 S 6/2000 Francis
6,070,723 A 6/2000 Lewis
6,085,497 A 7/2000 Natterer
6,085,942 A * 7/2000 Redmond ..... 222/107

6,105,259 A 8/2000 Meyers et al.
6,112,898 A 9/2000 Siragusa et al.
6,116,450 A 9/2000 Huang
6,153,232 A 11/2000 Holten et al.
D435,665 S 12/2000 Ogle
6,159,513 A 12/2000 Judlowe et al.
D438,125 S 2/2001 Kaposi et al.
D440,810 S 4/2001 Olson
6,209,748 B1 4/2001 Dunbar
6,213,662 B1 4/2001 Aljanedi
6,241,124 B1 6/2001 Hoyt
6,245,367 B1 6/2001 Galomb
6,254,907 B1 7/2001 Galomb
6,279,233 B1 8/2001 Cameron
D447,560 S 9/2001 Hellberg et al.
6,282,866 B1 9/2001 Natterer et al.
6,286,731 B1 9/2001 Lillelund et al.
6,287,612 B1 9/2001 Mandava et al.
6,295,735 B1 10/2001 Barger
6,299,012 B1 10/2001 Redmond
6,311,837 B1 11/2001 Blaustein et al.
6,328,928 B1 12/2001 Schroeder et al.
6,336,310 B1 1/2002 Redmond
6,341,472 B1 1/2002 Schroeder
6,347,727 B1 2/2002 Diaz
6,348,246 B1 2/2002 Finestone et al.
6,349,866 B1 2/2002 Stewart et al.
6,357,626 B1 3/2002 Zhang et al.
D456,507 S 4/2002 LeMarr et al.
6,364,113 B1 4/2002 Faasse, Jr. et al.
6,364,203 B2 4/2002 Toussant et al.
6,364,519 B1 4/2002 Hughes et al.
6,372,176 B1 4/2002 Ekendahl et al.
6,386,443 B1 5/2002 Szczerbinski
6,390,358 B1 5/2002 Stewart et al.
6,395,317 B1 5/2002 Singh et al.
D458,809 S 6/2002 Richardson et al.
6,412,653 B1 7/2002 Waterhouse
6,415,939 B1 7/2002 Redmond
D463,275 S 9/2002 Garcia
6,457,612 B1 10/2002 Zhang et al.
6,460,781 B1 10/2002 Garcia et al.
6,471,122 B1 10/2002 Stewart et al.
6,472,007 B2 10/2002 Bezek et al.
D467,336 S 12/2002 Gilbard et al.
D467,499 S 12/2002 Garza et al.
6,516,939 B1 2/2003 Schmidt et al.
D471,628 S 3/2003 Louviere
6,536,974 B2 3/2003 Redmond
6,550,224 B2 4/2003 Kleinschmidt
6,558,150 B1 5/2003 Karbach
6,589,041 B2 7/2003 Feil
6,589,042 B2 7/2003 Stammler et al.
6,596,328 B1 7/2003 Bezek et al.
D477,965 S 8/2003 Kortleven et al.
D479,674 S 9/2003 Freed
D480,318 S 10/2003 Settele
D482,578 S 11/2003 Kortleven et al.
6,649,114 B2 11/2003 Lochner et al.
6,651,848 B1 11/2003 Redmond
D482,939 S 12/2003 Freed et al.
D483,257 S 12/2003 Lim
D484,425 S 12/2003 Settele
6,655,903 B2 12/2003 Köhler
6,662,454 B2 12/2003 Harrold
6,663,019 B2 12/2003 Garcia et al.
6,673,301 B2 1/2004 Cargile et al.
6,675,482 B1 1/2004 Gilbert, Jr. et al.
6,685,058 B2 2/2004 Redmond
6,688,469 B1 2/2004 Barnes
6,691,901 B2 2/2004 Parve et al.
6,692,212 B2 2/2004 Trautwein et al.
D487,397 S 3/2004 Peghini
6,698,165 B1 3/2004 Natterer
6,699,006 B2 3/2004 Schlimgen et al.
6,701,692 B1 3/2004 Niehr
6,706,297 B1 3/2004 Toth et al.
6,712,599 B2 3/2004 Schlimgen et al.
D488,079 S 4/2004 Mastroianni
D488,394 S 4/2004 Overthun et al.
6,726,054 B2 4/2004 Fagen et al.
D489,820 S 5/2004 Masuda et al.
6,736,379 B1 5/2004 Wegner et al.
D492,407 S 6/2004 Masuda et al.
D494,676 S 8/2004 Dubniczki et al.
D494,877 S 8/2004 Kempe et al.
6,769,558 B1 8/2004 Bucholtz
6,769,684 B2 8/2004 Gandelheidt
6,783,030 B2 8/2004 Redmond
6,802,423 B2 10/2004 O'Brien
D500,850 S 1/2005 Clark et al.
6,845,597 B2 1/2005 Redmond
6,848,339 B2 2/2005 Hakim
6,851,920 B2 2/2005 Trautwein et al.
6,860,405 B1 3/2005 Poynter
6,874,665 B2 4/2005 Doherty et al.
6,905,323 B2 6/2005 Keller
6,910,623 B2 6/2005 Stewart et al.
6,928,870 B1 8/2005 Liebowitz
6,942,097 B1 9/2005 Stremple et al.
6,953,420 B2 10/2005 Karbach
6,957,909 B1 10/2005 Dingeldein et al.
D511,645 S 11/2005 Fort et al.
D514,935 S 2/2006 Sturk
7,004,322 B1 2/2006 Bartoli
7,005,109 B2 2/2006 Husar
D517,207 S 3/2006 Poynter
7,013,568 B2 3/2006 Schmidt
D524,610 S 7/2006 Kushner
7,069,705 B2 7/2006 Redmond
7,104,419 B2 9/2006 Fagen et al.
7,121,409 B1 10/2006 Hamilton et al.
D531,918 S 11/2006 Heiligenstein et al.
7,140,863 B2 11/2006 Koppenhofer
7,143,910 B2 12/2006 Redmond
D534,648 S 1/2007 Zahn et al.
7,175,215 B2 2/2007 Harris
D539,420 S 3/2007 Zahn et al.
7,198,161 B2 4/2007 Bucholtz
7,210,600 B1 5/2007 Delio, Jr.
7,219,816 B1 5/2007 Xia et al.
7,226,230 B2 6/2007 Liberatore
D545,636 S 7/2007 Risden
D545,640 S 7/2007 Risden
D547,134 S 7/2007 Everett et al.
D547,860 S 7/2007 Zahn et al.
7,240,797 B1 7/2007 Grossman
D548,834 S 8/2007 Hansen
7,258,255 B2 8/2007 Vogel et al.
D551,760 S 9/2007 Zahn et al.
7,270,239 B1 9/2007 Ross
D556,321 S 11/2007 Starnes
7,290,380 B2 11/2007 Natterer
7,293,683 B2 11/2007 Natterer
7,299,947 B2 11/2007 Lingenhoff
D560,442 S 1/2008 Teys et al.
D560,443 S 1/2008 Teys et al.
7,314,196 B2 1/2008 Gandelheidt et al.
7,314,328 B2 1/2008 Liberatore
7,320,398 B2 1/2008 Bertl et al.
7,325,370 B2 2/2008 Redmond
7,325,703 B2 2/2008 Gherdan et al.
7,325,994 B2 2/2008 Liberatore
D565,193 S 3/2008 Price
7,347,680 B2 3/2008 Hessenbruch
D567,004 S 4/2008 Bottega
7,361,008 B2 4/2008 Crepaz
7,370,564 B2 5/2008 Hennes
7,374,046 B1 5/2008 O'Brien
D570,164 S 6/2008 Teys et al.
D571,002 S 6/2008 Starnes
D572,089 S 7/2008 Teys et al.
D572,976 S 7/2008 Mansfield
7,413,080 B2 8/2008 Van House
7,413,083 B2 8/2008 Belfance et al.
7,431,529 B1 10/2008 Rushe et al.
D580,715 S 11/2008 Finell
7,478,960 B2 1/2009 Glover

| | | | |
|---|---|---|---|
| 7,487,625 | B2 | 2/2009 | Natterer et al. |
| 7,487,894 | B2 | 2/2009 | Zahn et al. |
| 7,490,974 | B2 | 2/2009 | Hennes |
| 7,503,604 | B2 | 3/2009 | Raeder et al. |
| 7,506,762 | B2 | 3/2009 | Nelson et al. |
| 7,513,397 | B2 | 4/2009 | Zahn et al. |
| D592,826 | S | 5/2009 | Lingenhoff |
| 7,540,291 | B2 | 6/2009 | Gandelheidt |
| 7,556,147 | B2 | 7/2009 | Leiner et al. |
| 7,562,796 | B2 | 7/2009 | Zahn et al. |
| 7,568,590 | B1 | 8/2009 | Gross et al. |
| 7,571,813 | B2 | 8/2009 | Weisskopf |
| 7,600,358 | B2 | 10/2009 | Natterer |
| D604,635 | S | 11/2009 | Xu |
| 7,628,125 | B2 | 12/2009 | Kaita et al. |
| 7,631,776 | B2 | 12/2009 | Vovan et al. |
| 7,637,417 | B2 | 12/2009 | Fite, IV et al. |
| 7,648,328 | B2 | 1/2010 | Binder et al. |
| D609,362 | S | 2/2010 | Rannikko et al. |
| 7,669,597 | B2 | 3/2010 | Sullivan et al. |
| 7,669,714 | B1 | 3/2010 | Grossman |
| 7,690,883 | B2 | 4/2010 | Huber et al. |
| 7,703,619 | B2 | 4/2010 | Van Puijenbroek |
| D636,890 | S | 4/2011 | Teys et al. |
| 7,922,021 | B2 * | 4/2011 | Golden ..... 220/4.22 |
| 7,993,692 | B2 | 8/2011 | Finley et al. |
| 8,028,837 | B2 | 10/2011 | Gerstle et al. |
| 8,091,242 | B2 | 1/2012 | Teys et al. |
| 8,151,984 | B2 | 4/2012 | Braeder et al. |
| 8,403,936 | B2 | 3/2013 | Hess et al. |
| 2001/0001470 | A1 | 5/2001 | Toussant et al. |
| 2002/0104856 | A1 | 8/2002 | Clark et al. |
| 2002/0113074 | A1 | 8/2002 | Baker et al. |
| 2002/0180114 | A1 | 12/2002 | Cargile et al. |
| 2003/0015605 | A1 | 1/2003 | Garcia et al. |
| 2003/0029868 | A1 | 2/2003 | Davidov et al. |
| 2003/0066870 | A1 | 4/2003 | Stewart |
| 2003/0183641 | A1 | 10/2003 | Asbury |
| 2003/0222099 | A1 | 12/2003 | Keller |
| 2004/0006874 | A1 | 1/2004 | Kamm et al. |
| 2004/0074802 | A1 | 4/2004 | Piliero et al. |
| 2004/0094548 | A1 | 5/2004 | Laveault |
| 2004/0105715 | A1 | 6/2004 | Spelman et al. |
| 2004/0187662 | A1 | 9/2004 | Ulmer et al. |
| 2005/0025561 | A1 | 2/2005 | Larsen |
| 2005/0042019 | A1 | 2/2005 | Gaynes et al. |
| 2005/0116482 | A1 | 6/2005 | Harris |
| 2005/0218106 | A1 | 10/2005 | Yui |
| 2005/0236442 | A1 | 10/2005 | Kratzer |
| 2005/0249031 | A1 | 11/2005 | Morgese et al. |
| 2005/0252351 | A1 | 11/2005 | Natterer |
| 2006/0124654 | A1 | 6/2006 | Cai |
| 2006/0191805 | A1 | 8/2006 | Vogel et al. |
| 2006/0283727 | A1 | 12/2006 | Nelson et al. |
| 2007/0012710 | A1 | 1/2007 | Vovan |
| 2007/0045317 | A1 | 3/2007 | Rosender et al. |
| 2007/0102308 | A1 | 5/2007 | Tremblay et al. |
| 2007/0125667 | A1 | 6/2007 | Lee et al. |
| 2007/0187277 | A1 | 8/2007 | Furlong |
| 2007/0235104 | A1 | 10/2007 | Lingenhoff |
| 2007/0267183 | A1 | 11/2007 | Hennes |
| 2008/0002921 | A1 | 1/2008 | Redmond |
| 2008/0034710 | A1 | 2/2008 | Ehrmann |
| 2008/0040862 | A1 | 2/2008 | Bravo |
| 2008/0072432 | A1 | 3/2008 | Teys et al. |
| 2008/0072433 | A1 | 3/2008 | Ohring et al. |
| 2008/0149523 | A1 | 6/2008 | O'Brien |
| 2008/0152767 | A1 | 6/2008 | Maisel |
| 2008/0191381 | A1 | 8/2008 | Hennes |
| 2008/0210716 | A1 | 9/2008 | Weyts |
| 2008/0278340 | A1 | 11/2008 | Jokele et al. |
| 2009/0000255 | A1 | 1/2009 | Dandl et al. |
| 2009/0025340 | A1 | 1/2009 | Natterer et al. |
| 2009/0050649 | A1 | 2/2009 | Rushe et al. |
| 2009/0057386 | A1 | 3/2009 | Redmond |
| 2009/0071099 | A1 | 3/2009 | Ehrmann et al. |
| 2009/0071100 | A1 | 3/2009 | Ehrmann et al. |
| 2009/0071107 | A1 | 3/2009 | Ehrmann |
| 2009/0097949 | A1 | 4/2009 | Binder et al. |
| 2009/0152261 | A1 | 6/2009 | Capriotti |
| 2009/0173039 | A1 | 7/2009 | Slomski et al. |
| 2009/0173041 | A1 | 7/2009 | Moessnang |
| 2009/0173049 | A1 | 7/2009 | Ruzic et al. |
| 2009/0217532 | A1 | 9/2009 | Cantu |
| 2009/0217625 | A1 | 9/2009 | Moessnang |
| 2009/0218374 | A1 | 9/2009 | Liberatore |
| 2009/0241469 | A1 | 10/2009 | Moessnang et al. |
| 2009/0255218 | A1 | 10/2009 | Moessnang |
| 2009/0260319 | A1 | 10/2009 | Botzenhardt et al. |
| 2009/0260320 | A1 | 10/2009 | Miller et al. |
| 2009/0260325 | A1 | 10/2009 | Haering |
| 2009/0260326 | A1 | 10/2009 | Grimm et al. |
| 2009/0261230 | A1 | 10/2009 | Imhof |
| 2009/0266028 | A1 | 10/2009 | Zeller et al. |
| 2009/0288365 | A1 | 11/2009 | Negele |
| 2009/0294454 | A1 | 12/2009 | Harding |
| 2009/0314415 | A1 | 12/2009 | Gross et al. |
| 2009/0314777 | A1 | 12/2009 | Gross et al. |
| 2010/0024360 | A1 | 2/2010 | Ehrmann et al. |
| 2010/0024668 | A1 | 2/2010 | Huber et al. |
| 2010/0065567 | A1 | 3/2010 | Vovan |
| 2010/0065582 | A1 | 3/2010 | Nelson et al. |
| 2010/0095640 | A1 | 4/2010 | Grimm |
| 2010/0107572 | A1 | 5/2010 | Slomp et al. |
| 2010/0108680 | A1 | 5/2010 | Vovan et al. |
| 2010/0116772 | A1 | 5/2010 | Teys |
| 2011/0024462 | A1 | 2/2011 | Teys |
| 2011/0100859 | A1 | 5/2011 | Burattini |

FOREIGN PATENT DOCUMENTS

| | | |
|---|---|---|
| AU | 750188 | 5/2001 |
| AU | 764881 | 9/2003 |
| AU | 2004 100000 | 2/2004 |
| AU | 200415919 | 6/2005 |
| AU | 200415920 | 6/2005 |
| BE | 1008054 | 1/1996 |
| CA | 2376147 | 4/2001 |
| CN | 2081671 | 7/1991 |
| DE | 2124931 | 11/1972 |
| DE | 2232861 | 1/1974 |
| DE | 7523870 | 11/1976 |
| DE | 19627243 | 1/1998 |
| DE | 19904649 | 10/2000 |
| DE | 7237741 | 10/2002 |
| DE | 202004006760 | 9/2005 |
| DE | 102004055796 | 5/2006 |
| DE | 102005028618 | 12/2006 |
| DE | 102007009457 | 8/2008 |
| EP | 496587 | 7/1992 |
| EP | 0778018 | 6/1997 |
| EP | 937655 | 8/1998 |
| EP | 1068850 | 10/2000 |
| EP | 1121922 | 8/2001 |
| FR | 1418834 | 11/1965 |
| FR | 2063745 | 9/1971 |
| FR | 2169652 | 9/1973 |
| FR | 2622424 | 5/1989 |
| FR | 2680456 | 2/1993 |
| FR | 2697331 | 4/1994 |
| GB | 890770 | 3/1962 |
| GB | 1017425 | 1/1966 |
| GB | 2343440 | 5/2000 |
| GB | 2351272 | 12/2000 |
| GB | 2373710 | 10/2002 |
| GB | 2375040 | 11/2002 |
| GB | 2382020 | 5/2003 |
| GB | 2383989 | 7/2003 |
| GB | 2401025 | 11/2004 |
| GB | 2418193 | 3/2006 |
| GB | 2454230 | 5/2009 |
| JP | 6278655 | 5/1987 |
| JP | 01-084846 A | 3/1989 |
| JP | 1104271 | 7/1989 |
| JP | 04082701 | 3/1992 |
| JP | 4122213 | 4/1992 |
| JP | 7255581 | 10/1995 |
| JP | 9252911 | 9/1997 |
| JP | 2000005024 | 1/2000 |

| | | | |
|---|---|---|---|
| JP | 2000333811 | | 12/2000 |
| JP | 2001299552 | | 10/2001 |
| JP | 2005152558 | | 6/2005 |
| KR | 100740376 | B1 | 7/2007 |
| NL | 1036045 | | 10/2009 |
| SI | 9400348 | | 4/1996 |
| SI | 9600327 | | 6/1998 |
| WO | 9630272 | | 10/1996 |
| WO | 9703634 | | 2/1997 |
| WO | 9706073 | | 2/1997 |
| WO | 9713428 | | 4/1997 |
| WO | 9734816 | | 9/1997 |
| WO | 9808751 | | 3/1998 |
| WO | 9819583 | | 5/1998 |
| WO | 9851259 | | 11/1998 |
| WO | 9903441 | | 1/1999 |
| WO | 9909871 | | 3/1999 |
| WO | 9944482 | | 9/1999 |
| WO | 9961337 | | 12/1999 |
| WO | 0100134 | | 1/2001 |
| WO | 0136293 | | 5/2001 |
| WO | 0170080 | | 9/2001 |
| WO | 0232782 | | 4/2002 |
| WO | 03055435 | | 7/2003 |
| WO | 03086900 | | 10/2003 |
| WO | WO 2004063048 | | 7/2004 |
| WO | 2005/065498 | | 7/2005 |
| WO | 2005116590 | | 12/2005 |
| WO | 2006000376 | | 1/2006 |
| WO | 2006051305 | | 5/2006 |
| WO | 2006/137674 | | 12/2006 |
| WO | 2007082034 | | 7/2007 |
| WO | 2007087357 | | 8/2007 |
| WO | 2008092200 | | 7/2008 |
| WO | 2008/092200 | | 8/2008 |
| WO | 2009006690 | | 1/2009 |
| WO | 2009047821 | | 4/2009 |
| WO | 2010065980 | | 6/2010 |

OTHER PUBLICATIONS

Written Opinion of the International Searching Authority, dated Apr. 6, 2009, from corresponding International Application No. PCT/AU2008/001809, filed Dec. 9, 2008 (9 pages).

U.S. Appl. No. 12/795,220, filed Jun. 7, 2010, entitled Reclosable Container, 45 pages.

U.S. Appl. No. 13/041,131, filed Mar. 4, 2011, entitled Fracturable Container, 42 pages.

European Patent Office, Communication dated Dec. 3, 2012, from related European Patent App. No. 08878659.5, 7 pages.

European Patent Office, Communication dated Dec. 20, 2012, from related European Patent App. No. 08878659.5, 8 pages.

Japanese Patent Office, Notice of Reason of Rejection for Application No. 2007-548642, mailed Mar. 9, 2010, which contains a concise statement of relevance of Japanese references 62-78655 and 1-104271, 2 pages.

Letter regarding first Office Action in related Chinese Patent Application No. 200880132571.3, letter dated Dec. 18, 2012, 2 pages.

* cited by examiner

DISPENSING CONTAINER

CROSS REFERENCE TO RELATED APPLICATIONS

This application is a national phase application of International Application No. PCT/AU2008/001809, filed Dec. 9, 2008, designating the United States, which is incorporated by reference herein in its entirety.

FIELD OF THE INVENTION

The present invention relates generally to containers that can store and dispense contents, and is particularly useful in relation to disposable dispensing containers for dispensing of a single serve, or a limited number of serves, of contents. It will be convenient to hereinafter describe the invention in relation to that application. It should be appreciated, however, that the present invention is not limited to that application, only.

BACKGROUND OF THE INVENTION

Containers and packaging for storing and dispensing contents of various types are available in a wide range of shapes and sizes, and have a number of different functionalities.

Where it is desirable to provide a single serve, or a limited number of serves, of a product (for example, liquid or powdered foods for use by customers requiring snack products), or to provide a measured or metered amount of a product (for example, a medicament) disposable packaging containers are frequently used. Provision of such limited serve sizes reduces the incidence of spoilage and the incidence of wastage, as each customer takes what is required and it does not become necessary to discard excess unused or spoiled quantities. In addition to reducing spoilage and waste, provision of single serve (or a limited number of serves) containers also reduces spillage and mess.

It is also desirable to provide a container for dispensing contents which incorporates additional features for enhanced functionality, and such a container, being in the form of a dispensing utensil, is disclosed in WO 2005/065498, the entire contents of which are incorporated by reference.

The dispensing utensil of WO 2005/065498 advantageously dispenses products, such as sugar, from a utensil having a container with a snap open and close end, such that it is not necessary to provide a separate utensil, such as a spoon for tea or coffee. Hence, mess is further reduced, in that separate sugar sachets and stirrers are not required.

WO 2008/092200, the entire contents of which are incorporated herein by reference, improves on WO 2005/065498 by providing a seal around the snap open and close feature. The seal prevents the ingress of liquids or gaseous vapours through the weakened area at the snap open and close feature, thereby, preventing contents of the dispensing utensil spoiling.

Any discussion of documents, devices, acts or knowledge in this specification is included to explain the context of the invention. It should not be taken as an admission that any of the material formed part of the prior art base or the common general knowledge in the relevant art on or before the priority date of the claims herein.

SUMMARY OF THE INVENTION

A first aspect of the present invention provides a dispensing container having:

a body, the body defining a cavity for storing dispensable cavity contents and having an opening;

a covering adaptable to close said opening; and a lid connected to the body by a failure zone and openable, in use, after failure of the failure zone, about a hinge formed by the covering providing access to the dispensable cavity contents.

Preferably:

a substantial portion of the body is rigid;

the covering lid is flat;

a substantial portion of the lid is rigid; and

Preferably, the body further includes a reinforcing rib adjacent the lid. In one embodiment, the lid and rib are positioned adjacently to form a failure zone (being a slot) therebetween. In another embodiment, the rib and lid are integrally formed with a failure zone therebetween.

In alternative embodiments of the invention, the lid may be formed separately from or may be formed integrally with the body.

The failure zone may be created by one or more pin holes, laser scoring or other method to weaken the area with respect to the surrounding material.

In a preferred embodiment, the lid is re-closable after opening, to prevent egress of contents.

In a further alternative embodiment of the invention, the body and lid may be moulded plastic and the covering may be a polymer, paper, film, foil, membrane or a laminate of these materials.

In another embodiment, the covering may be moulded plastic and, preferably, the covering is detachable and re-attachable to the body.

Preferably, the covering is contoured moulded plastic having a first lip snappable over a corresponding feature or features on the body.

Further preferably, the contoured covering includes a recessed or protruding surface with respect to the plane of the opening and the recessed or protruding surface has a folding element, which allows the lid to hinge, after failure of the failure zone.

Preferably, the folding element is a notch across the contoured lid at the hinge. A notch, in this context, being a concave, V-shaped, or generally widening cut, incision or groove across a surface. The correct orientation of the notch is such that the widening portion of the notch is spaced apart from the hinge.

In a further alternative embodiment of the invention, the covering is connected to the body. Preferably, the covering is hinged to the body.

Preferably, the container is capable of limiting the impregnation of water and air.

In a further alternative embodiment of the invention, the body includes at least one gripping element. Preferably, the or each gripping element includes one or more recessed portions in the body. Preferably, there are two gripping elements on opposite sides of the body having a generally scallop or concave shape. Alternatively, the gripping elements are generally designed to be ergonomic to human hands to enable easy opening. Preferably, the gripping elements provide a lateral support function for the container.

In one embodiment, the body is pliable, thereby enabling a user to squeeze the dispensing container in order to dispense some or all of the cavity contents. Preferably, the body comprises two or more ridges connected by a resilient or pliable portion and, in use, the squeezing of the two or more ridges produces a bellows action on the contents of the container.

In yet a further embodiment, the body, covering and/or lid is transparent.

Preferably, the lid includes a rigid thumb or finger rest.

In a preferred embodiment, the container includes a second cavity formed in the body and a second lid for separate access to the second cavity. In alternative embodiments, a third or subsequent cavity and third or subsequent lid may be included. It is also envisaged that the body may less lids than cavities, with a single lid allowing access to separately stored dispensing contents.

Preferably, the covering includes one or more ribs extending from a surface of the covering intended to cover the opening. Further preferably, the ribs are capable of extending through the cavity to the inner surface of the body. Preferably, the ribs include openings to allow fluid flow therethrough. Alternatively, the ribs extend part way through the cavity.

In a preferred embodiment, the container includes a failure zone as described with reference to the second aspect of the present invention.

A second aspect of the present invention provides a dispensing container having a body and a lid including:

a failure zone in a first portion of a connection between the lid and the body;

a hinge in a second portion of a connection between the lid and the body, wherein the failure zone includes a failure portion, a body portion and a lid portion, the lid portion extending beyond the end of body portion, the failure zone, in use, having the failure portion fail after the application of a failure force, enabling opening of the lid, and the lid portion deforming around the container portion upon application of a closure force, thereby re-closing the lid.

Preferably, the body portion is a lip extending towards the interior of the container from the body and the failure portion forms the middle section of a "Z" shape between the body portion and the lid portion.

A third aspect of the present invention provides a method of manufacturing a dispensing container including the steps of:

forming a container assembly, including a body, a lid;

filling the container assembly with contents to be dispensed; and sealing the container assembly with a covering.

Preferably, the method includes forming multiple dispensing containers in a single operation.

Preferably, the multiple formed dispensing containers are connected together at one or more failure zones.

BRIEF DESCRIPTION OF THE DRAWINGS

Other features and advantages of one or more preferred embodiments of the present invention will be readily apparent to one of ordinary skill in the art from the following written description with reference to and, used in conjunction with, the accompanying drawings, in which:

FIGS. 1*a* to 1*c* show a top perspective view of a dispensing container, without a covering for clarity purposes, according to an embodiment of the present invention, in which FIG. 1*a* shows a lid and body of the container before opening, FIG. 1*b* shows the lid after opening and FIG. 1*c* shows the lid re-closed;

DESCRIPTION OF PREFERRED EMBODIMENT

Figure 1A:
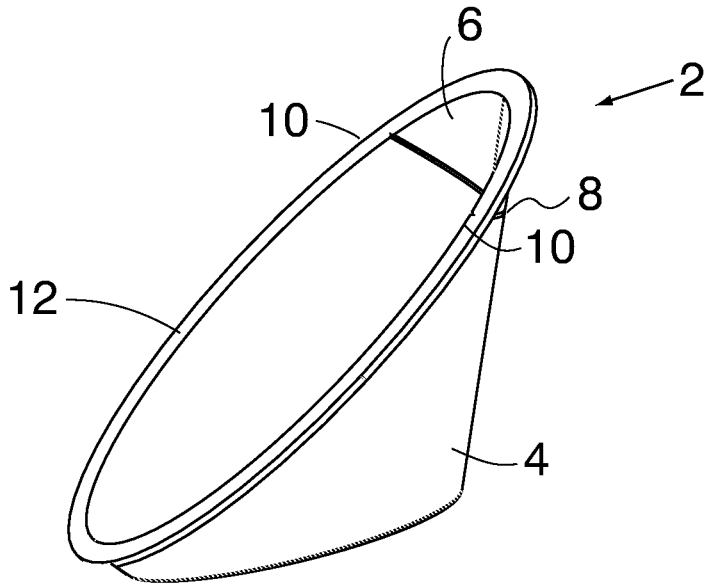

For the sake of clarity, reference numerals are used herein, with like numerals used on various embodiments of the invention to refer to like or comparable features having like or comparable functionality.

A dispensing container according to a preferred embodiment of the present invention, in its assembled form, includes a body portion, a lid portion and a covering. The body portion defines a cavity for storing dispensable cavity contents and the lid portion is connected to the body by a failure zone to enable access to the cavity contents. The lid portion is openable about a hinge formed by the covering and/or the body. Applying a failure force to the lid, which is typically provided by a persons thumb or finger, causes the failure zone to fail and the lid to open about the hinge formed by the covering and/or body, thereby allowing the cavity contents to be dispensed.

Figure 1B:
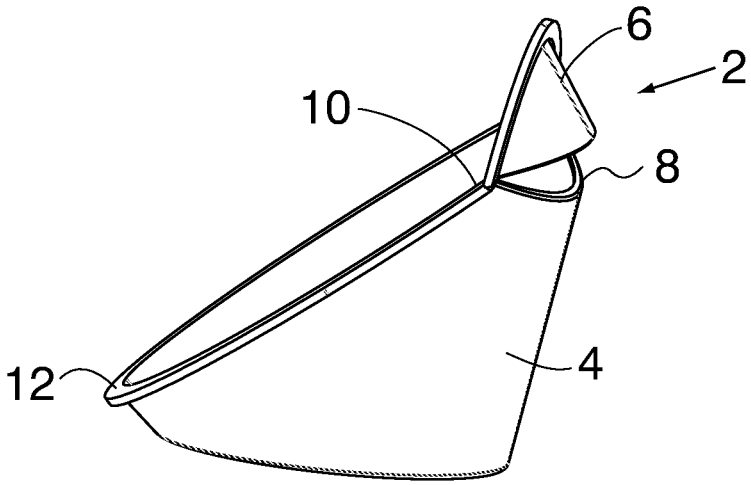

Referring to FIGS. 1*a* to 1*b*, a dispensing container 2 is shown in perspective view having a body 4 and a lid 6, connected about a failure zone 8 and hinge 10. In this embodiment, the body 4 and lid 6 define a rim 12 which further defines an opening over which a covering is placed. The plane of the opening and failure zone 8 forms an angle of 90° or less as measured from the point of view of lid 6. Hence, application of force to the lid in a direction perpendicular to the plane of the opening results in the lid opening in a counter-clockwise direction (as shown). In FIGS. 1*a* to 1*b*, the covering has been omitted to better show the operation of the lid 6.

In FIG. 1*a*, the failure zone 8 is intact and, when the covering is in place, the lid 6 prevents egress of contents from within the container 2. In FIG. 1*b*, a failure force has been applied to the lid 6 such that the failure zone 8 has failed and the lid 6 and container 4 have become separated along the failure zone 8. The lid 6 would be retrained on the covering (which is not shown) but the rim 12 has failed at hinges 10. In other embodiments, the rim 12 does not shear or crack but rather deforms. Hence the hinges 10 may be provided on rim 12 as a supplement to the hinged rotation of the lid 6 about the covering. The various arrangements and operation of the body, cover and hinged lid may be as detailed in WO 2005/065498 and WO 2008/092200, as are various means of creating the failure zone.

Figure 1C:
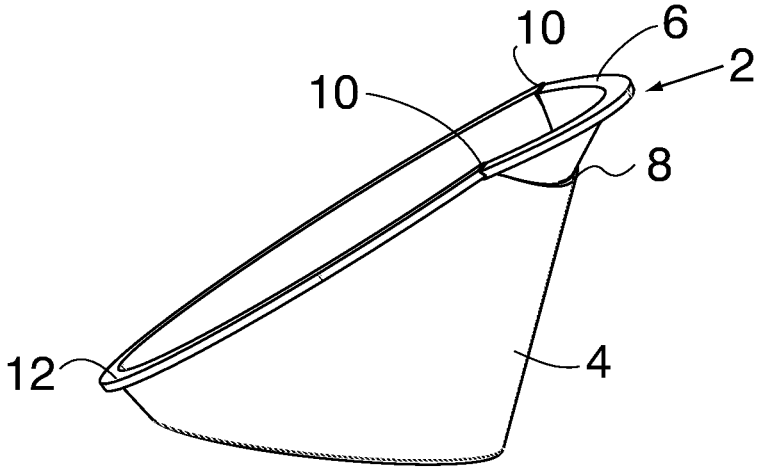

Once the lid is opened the contents of the container 2, or at least some of the contents, can then be dispensed. In FIG. 1*c*, the lid 6 has been re-closed on the body 4 by application of a closure force and through the arrangement of the failure zone 8, which is described in greater detail with relation to FIGS. 14 and 15 below.

The failure zone 8 can be created using a plurality of small flaws, 'pin pricks', weakened lines from laser scoring or other weakening means as stress concentrators, creating a zone in which failure will occur as lid 6 is opened. Provision of an encapsulated 'air bubble' or other inclusion would also raise the stress concentration at that point and reduce the force required to cause yielding when the lid 6 is opened. A small slot or hole could also be provided, rather than a slot extending the width of the lid. The failure zone 8 may be deliberately weakened by 'pin pricks' or other treatments, or may be an area of relative weakness resulting from the geometric configuration of the invention. Hence, strategic placement of a reinforcing rib, the size or stiffness of the lid or other factors may be used to create an area of relative weakness and hence a failure zone.

Figure 2A:
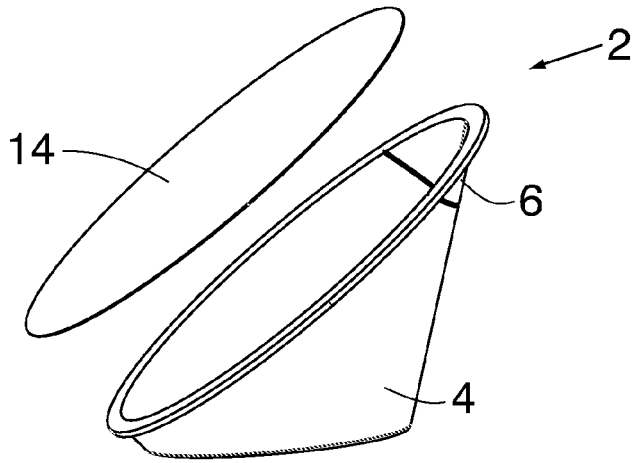
FIGS. 2*a* to 2*c* shows a top perspective view of the container of FIGS. 1*a* to 1*c* with alternative covering arrangements.

Referring now to FIG. 2*a*, the container 2 of FIGS. 1*a*, 1*b* & 1*c* is now shown with a covering 14. In FIG. 2*a*, the covering 14 is separate from the body 4 and lid 6. Once the container 2 has been filled with contents, the covering 14 would be attached to the body 4 and lid 6.

The covering 14 can be made of polymer, paper, film, foil, membrane or a laminate of these materials or may be moulded plastic. In the arrangement of FIG. 2*a*, the covering 14 would be adhered, with an appropriate adhesive, or welded, by heat welding, ultrasonic welding, induction welding or other appropriate process, to the body 4 and lid 6 to seal the contents in the container.

Figure 2B:
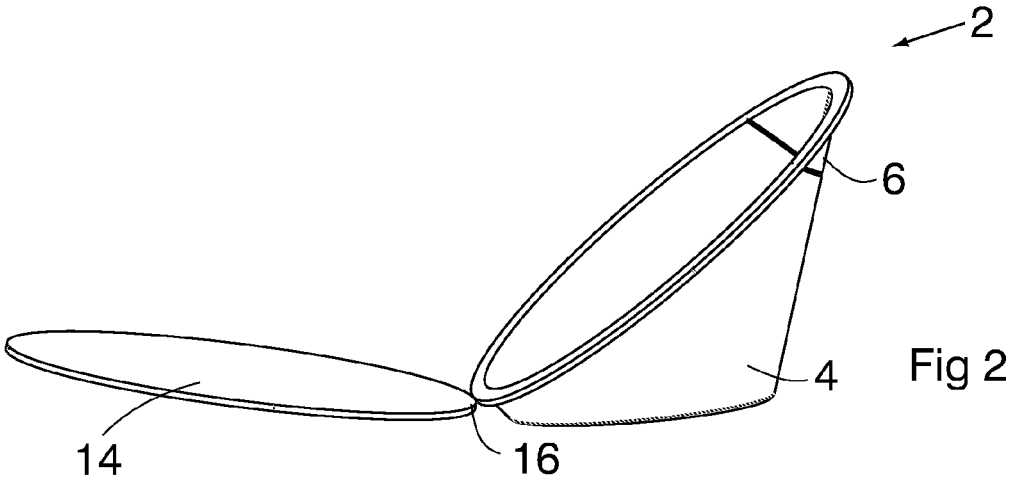
Figure 2C:
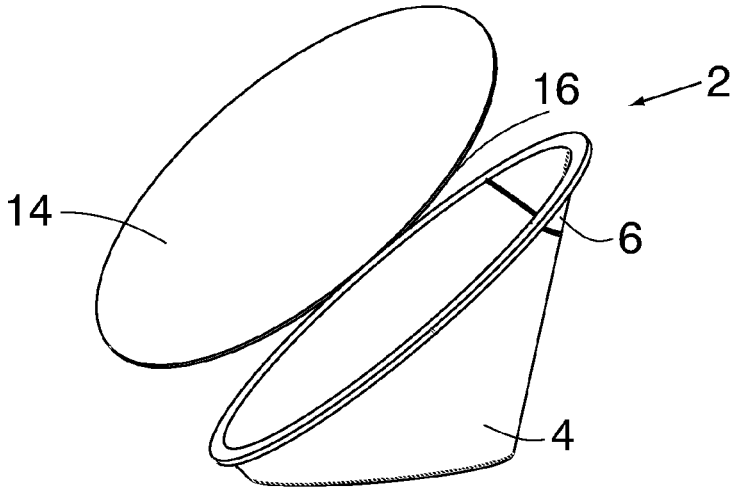

FIGS. 2*b* and 2*c* shows an alternative arrangement of the covering 14 in which a second hinge 16 is provided. With this arrangement, the entire container may be manufactured in a single operation by a suitable moulding technique. This allows for the removal of a placing step in the manufacture process as the covering 14 is already attached to the body 4 and simply needs to be folded over after the contents have been placed in the container before adhering or welding. Furthermore, through use of a suitable moulding technique, in-mould labelling of the covering (and/or the body of the container) may be used to manufacture in a single moulding process, a single piece container which can be simply and quickly top-filled, cover folded and sealed to produce a finished product requiring no further labelling, coating, capping etc. Accordingly, the manufacturing process may be more easily automated in a process having few steps at low cost. The process also avoids the need for relative positioning of sealing covers, labels etc. Furthermore, the container may also have coatings, which may be either internal or external, to improve barrier properties, reduce oxygen, air or water vapour transmission.

Figure 3A:
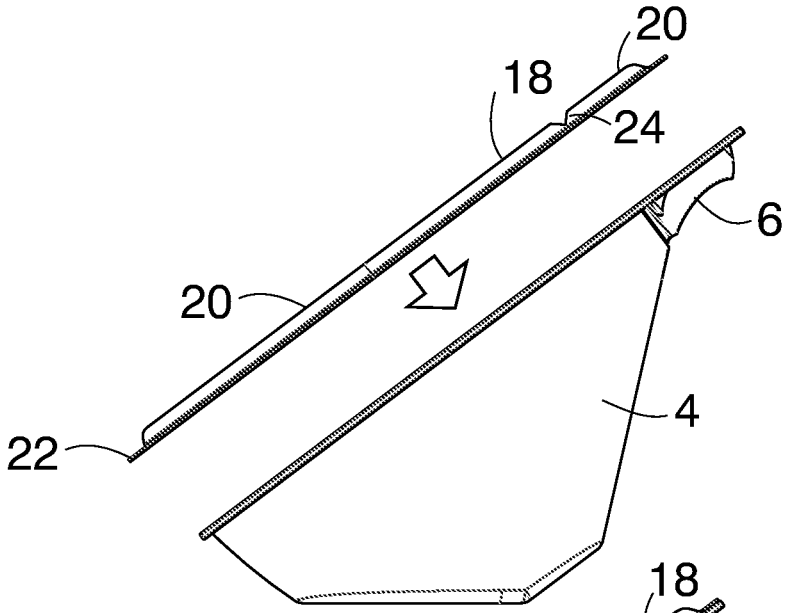
FIGS. 3*a* to 3*c* shows a top perspective view of a dispensing container having a contoured covering.
Figure 3B:
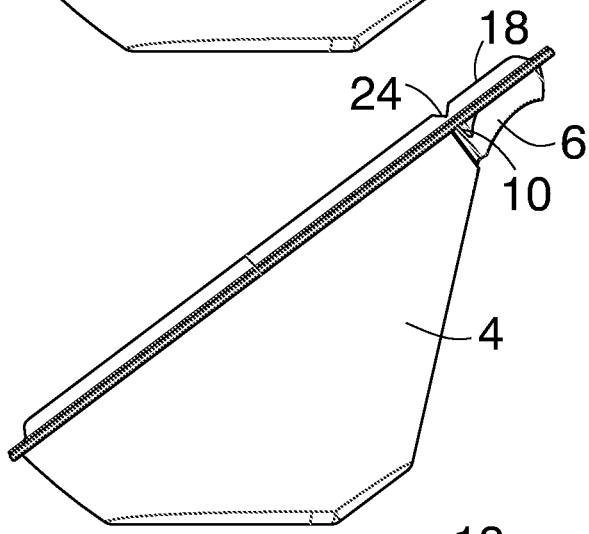
Figure 3C:
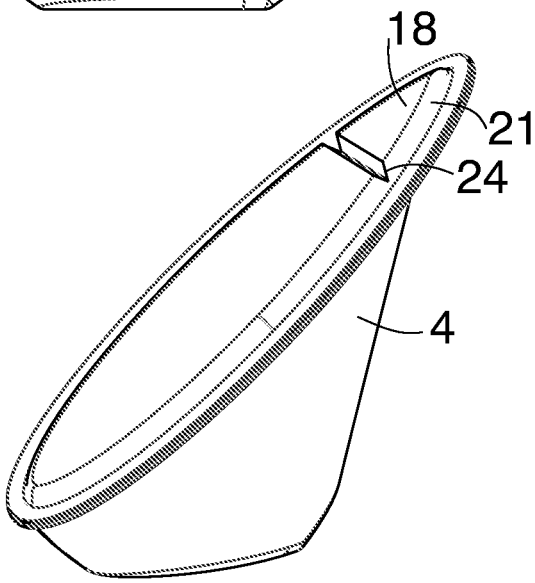

FIGS. 3*a* to 3*c* show a further alternative arrangement of a covering 18 on a body 4 and lid 6 as discussed with relation to FIGS. 1*a* to 1*c* and FIGS. 2*a* to 2*c*. In this arrangement, covering 18 has a contoured profile, that is, part of the covering 18 forms a protruding surface 20 with respect to a plane 22 which is parallel to the plane of the opening defined by rim 12. In a similar manner, the protruding surface 20 could instead be a recessed surface (not shown).

A contoured covering is also advantageous where the opening is relatively large and/or the container must support other filled containers during storage transport or display. A contoured profile may be made as thick as necessary, be made of a puncture resistant material and be provided with stiffening ribs or be shaped, as shown in FIGS. 3*a* to 3*c*, to provide a protruding surface 20 of smaller cross sectional area than the opening, the protruding surface 20 supported upon a stiffening skirt 21.

A protruding or recessed surface can also provide a platform for advertising material and/or for stable stacking of containers with coverings in place. For these reasons, contoured packaging may be desirable for certain products. Provision of a protruding surface may allow the under side of the covering to be concave, providing a small air head space in the container once filled. This may be desirable for certain types of contents.

An issue with protruding or recessed surfaces relates to the hinge mechanism required for opening the lid 6. To solve this issue, as shown in FIGS. 3*a* to 3*c*, a notch 24 is provided across the protruding surface 18 at the hinge 10. Although the notch shown in FIGS. 3*a* to 3*c* is a "V" notch, other shaped notches are envisaged. In particular, concave or otherwise generally widening shapes from the hinge are appropriate, as this enables the hinge 10 to operate without restriction. Furthermore, provision of the notch 24 further stiffens the contoured covering.

In on embodiment (not shown), the contoured covering 18 of FIGS. 3*a* to 3*c* further includes a lip which is snappable over a corresponding feature on the body 4. This may be advantageous in positioning the covering 18 prior to sealing or welding the covering 18 to the body 4 and lid 6. Furthermore, if not sealed, this provides the possibility of detaching and re-attaching the covering 18 from the body 4 and lid 6.

A contoured covering can hence avoid the need to provide secondary closure or protection means, unlike some forms of foil seals which require a secondary protective cover for durability.

Figure 16A:
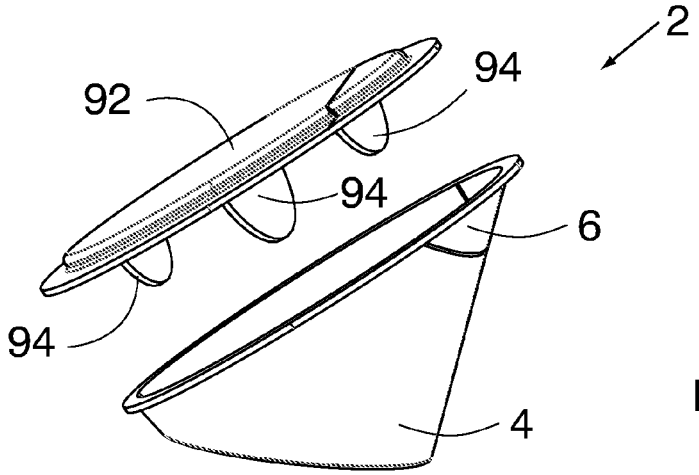
FIGS. 16*a* and 16*b* show a perspective view of the embodiment of FIGS. 3*a* to 3*c* showing a covering reinforced with ribs.
Figure 16B:
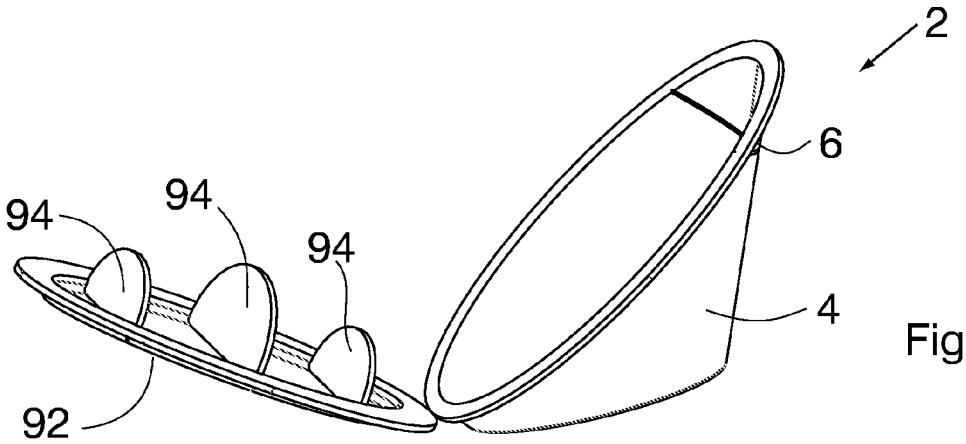

An alternative embodiment of a container 2 with body 4 and lid 6, shown in FIGS. 16 and 16*b*, includes a covering 92 with ribs 94. The ribs 94 stiffen the container and can extend right through to the inside surface of the body 4 or only part way through. If the ribs 94 extend right through to the inside surface of the body, the ribs 94 would be made with openings such that fluid may pass through them. The ribs 94 can increase the force required to squash a container 2 significantly. In this manner, a greater number of containers 2 could be stacked on top of each other or a more robust container can be provided where the application requires it.

Figure 4A:
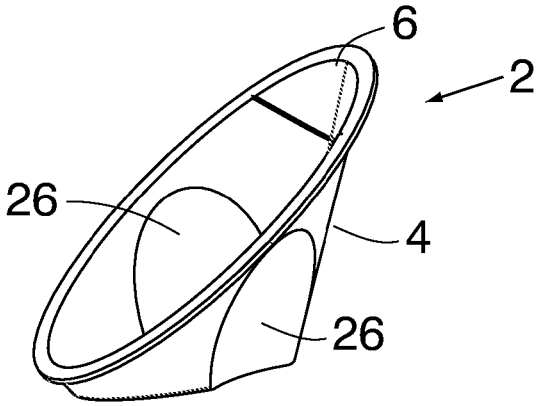
FIGS. 4*a* and 4*b* show a top perspective view of a dispensing container having gripping elements.
Figure 4B:
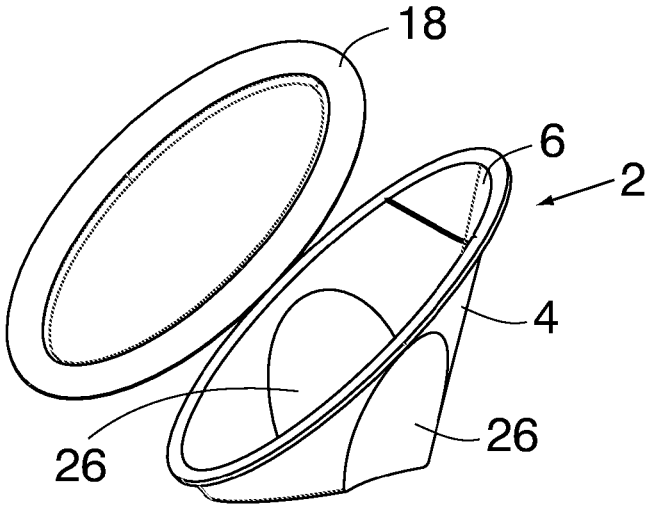

Referring now to FIGS. 4*a* and 4*b*, a preferred arrangement of the body 4 is shown in which gripping elements 26 are provided. In this example, the gripping elements are in the form of concave recesses, or scallops, either side of the body 4 of the container 2. With the gripping elements 26, not only is it easier for a person to grip the container 2 with their hands, it is also more comfortable. In addition, the gripping elements 26 can provide a "gripping effect" when the container 2 is stacked with another container of the same shape. The gripping elements 26, whether intended to be gripped by human hands, another container or both, also provide a lateral support function. That is, the gripping elements 26 allow for greater force to be applied to the top of the container 2 before the container 2 would be crushed. For containers of a size which do not require "grips" for use by human hands, the gripping elements 26 can provide a purely lateral support function.

Furthermore, the body 4 although sufficiently rigid to support itself and other products stacked upon it, can be made of flexible or pliable materials such that, once the container 2 is opened, the body 4 may be pushed or squeezed in order to dispense contents. This is particularly useful where the contents are a viscous liquid, such as sauces, paint, cremes, pastes and the like. The action of pushing on the pliable body 4, and a pliable covering 18, which can also be made of pliable materials, also provides control in the amount of contents dispensed. Where the contents are of a more free-flowing nature, the pliable or flexible body 4 may also be used to prevent further dispensing, for example, dispensing only half the contents.

Figure 5A:
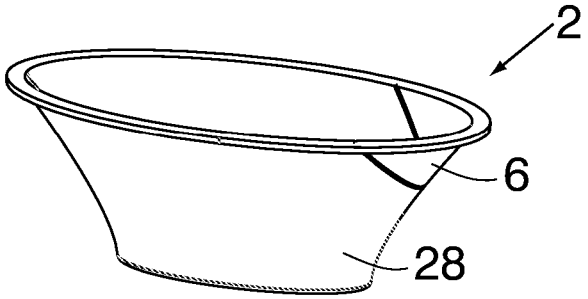
FIGS. 5*a* and 5*b* show a top perspective view of an alternative shape of a dispensing container according to an embodiment of the present invention.
Figure 5B:
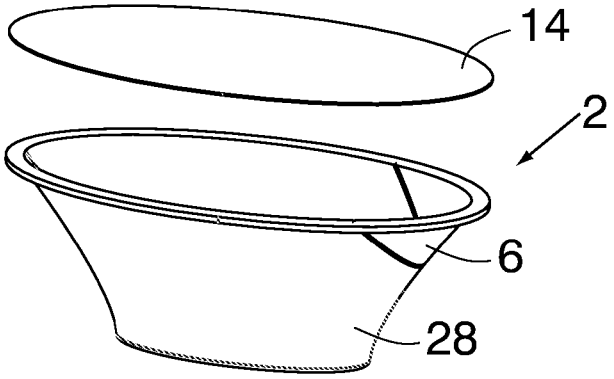

Referring now to FIGS. 5*a* and 5*b*, a container 2 is shown with an alternative body 28, in which the shape is changed so that the container 2 stands on a horizontal surface with the covering 14 also horizontal. The container 2 of FIG. 5*a* may be provided with any of the flat, hinged or contoured lids described herein. For some products, it is desirable.

Figure 7A:
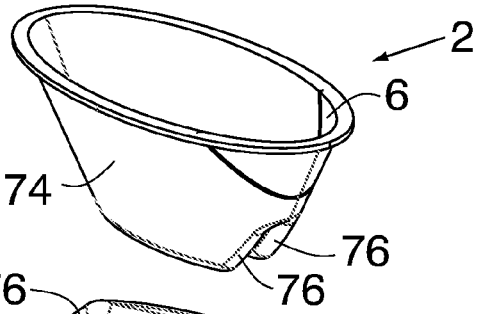
FIGS. 7*a* and 7*b* show a top perspective view and a bottom perspective view of an alternative shape of a dispensing container according to an embodiment of the present invention.
Figure 7B:
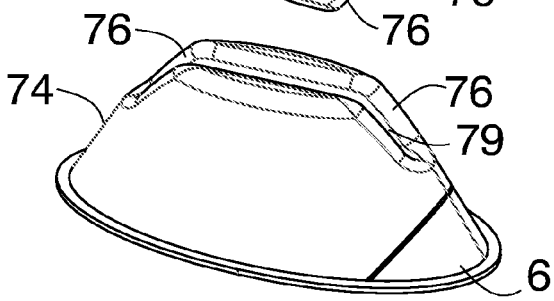

FIGS. 7*a* and 7*b* introduce an alternative embodiment of the container 2 having a body 74. The body 74 is provided with ridges 76 along a bottom surface (opposite that of the opening of the body). Between the ridges a resilient, or pliable, surface 79 is provided. In use, a person grips either side of the body 74, after opening the lid 6, and squeezes the contents of the container 2 out. The ridges 76 and resilient surface 79 act as a bellows to encourage the egress of the contents.

Figure 6A:
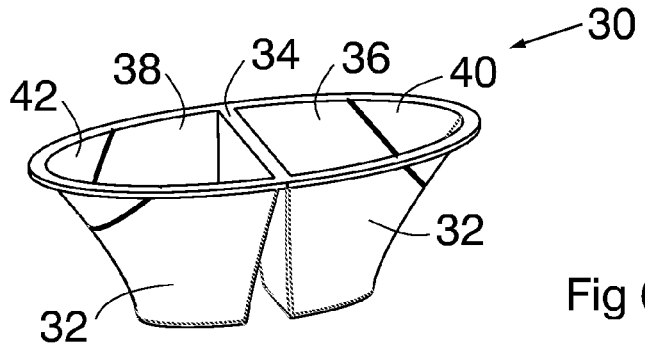
FIGS. 6*a* to 6*c* show a top perspective view of a dispensing container according to another embodiment of the present invention with two cavities and two lids.
Figure 6B:
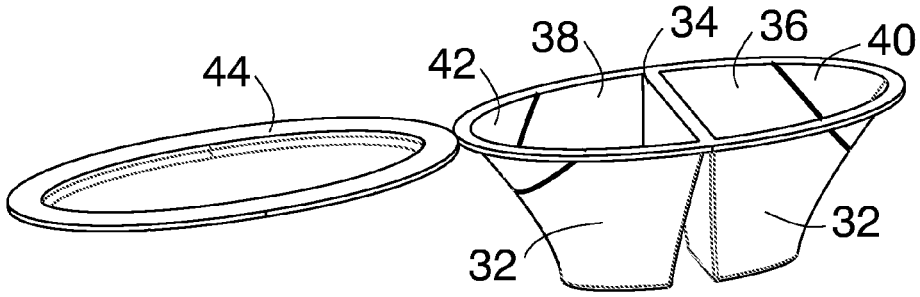
Figure 6C:
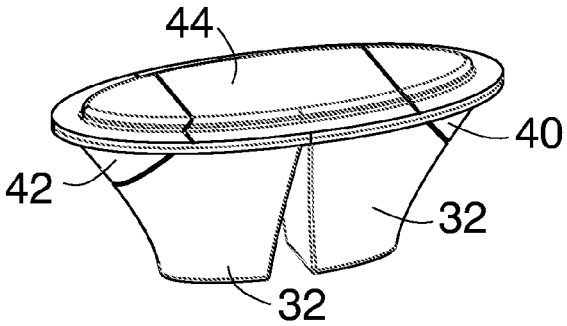
Figure 9:
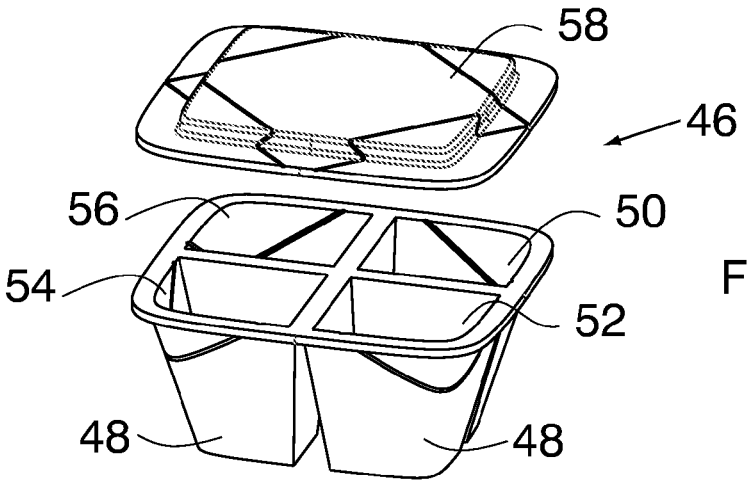
FIG. 9 shows a top perspective view of a dispensing container according to another embodiment of the present invention with four cavities and four lids.

Referring now to FIGS. 6*a* to 6*c*, a further embodiment of the invention is shown in which a container 30 has a body 32 with a dividing portion 34 creating a first cavity 36 and a second cavity 38. To allow access to the two cavities 36, 38, a first lid 40 and second lid 42 are provided. A covering 44 for the body 32 and lids 40 and 42, is provided. In other embodiments, a body of a container may be divided in to more than two cavities. For example, FIG. 9 shows a container 46 with a body 48 having four cavities 50, 52, 54, 56, each with respective lids, and a covering 58.

The embodiments of FIGS. 6*a* to 6*c* and 9 have separate lids for each cavity section, however, a single lid for all sections could also be provided. The provision of multiple cavity sections is useful, for example, for complimentary products such as provision of coffee and sugar, salt and pepper, 'two-part' adhesive glues, shampoo and conditioner (each in separate cavities) as it is desirable to provide the contents separately, but the contents may be required to be provided for use at the same time. Multiple cavity sections are also useful for providing multiple individual provision of a product such as tack/nail dispensers, dishwashing/laundry powder measures or cigars.

Figure 8A:
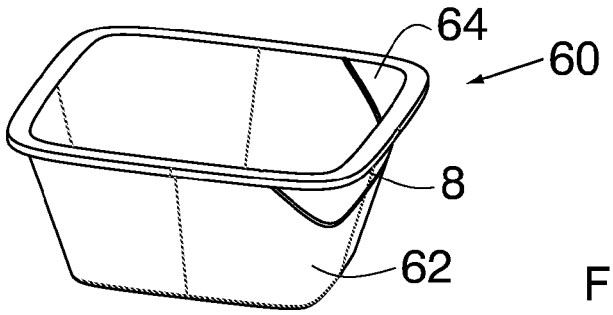
FIGS. 8*a* to 8*c* show a top perspective view of an alternative shape of a dispensing container according to an embodiment of the present invention.
Figure 8B:
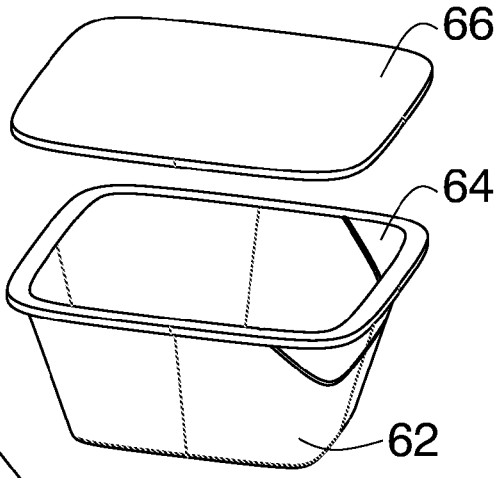
Figure 8C:
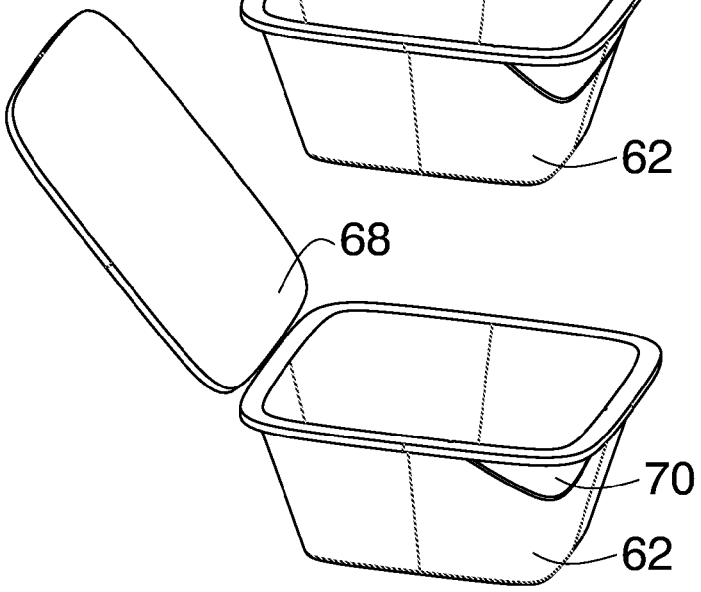

Referring now to FIGS. 8*a* to 8*c*, an alternative container 60 is shown with an alternative body 62. In this example, the body 62 is of generally cuboidal or frusto-pyramidal shape. In FIG. 8*a*, a lid 64 is provided across an entire width, enabling a large opening when the failure zone has failed. FIG. 8*b* simply shows an appropriate covering 66 which can be adhered or welded to the body 62 and lid 64. FIG. 8*c* provides a hinging covering 68 along with a lid 70 only on a single corner of the body 62, demonstrating the many different variants that can be encompassed within the invention.

Figure 10:
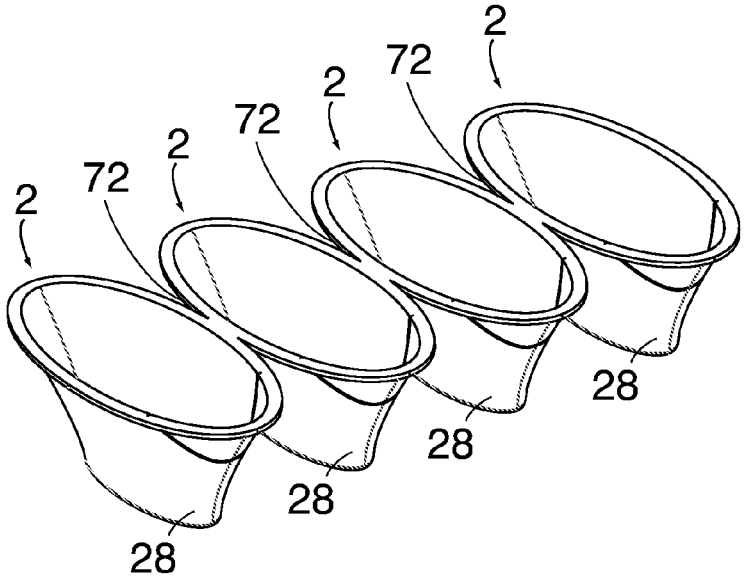
FIG. 10 shows a top perspective view of the body and lid of ganged multiples of the embodiment of FIG. 5, as would be produced during manufacture, connected at the edges of the bodies.
Figure 11:
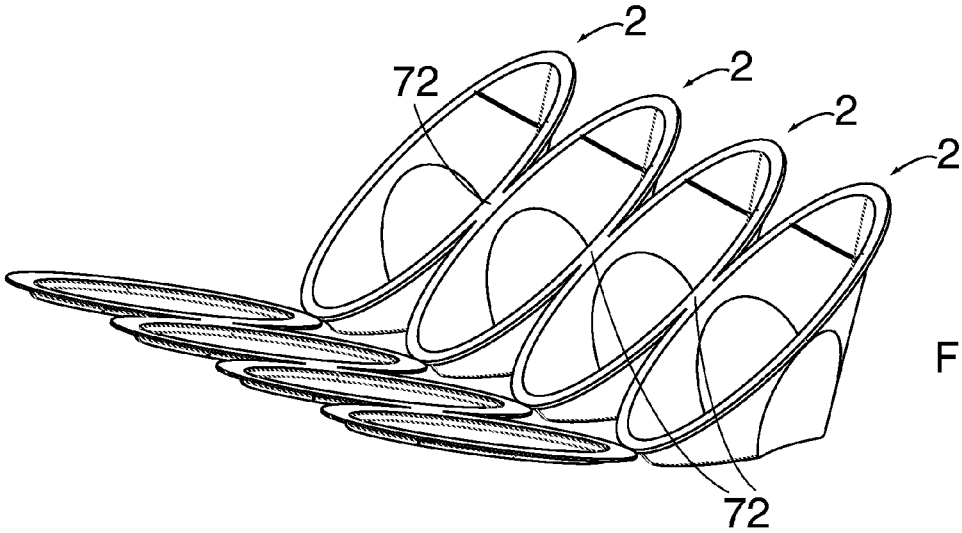
FIG. 11 shows a top perspective view of the embodiment of FIG. 4, in ganged form as would be produced during manufacture, connected at the edges of the bodies and with coverings hinged to the bodies.

FIGS. 10 and 11 show the embodiments of FIGS. 5 and 1 to 4, respectively, as they can be produced during manufacture. That's is, as shown in FIG. 10 multiple body and lid parts may be manufactured in a single operation and left connected at joint 72 for ease of handling during subsequent process steps. FIG. 11 further demonstrates the ability during manufacture to generate in a single operation, such as by injection moulding, as all components, body, lid and covering, are generated in the same step. Once again, the individual containers can be left connected at a joint 72.

Figure 12:
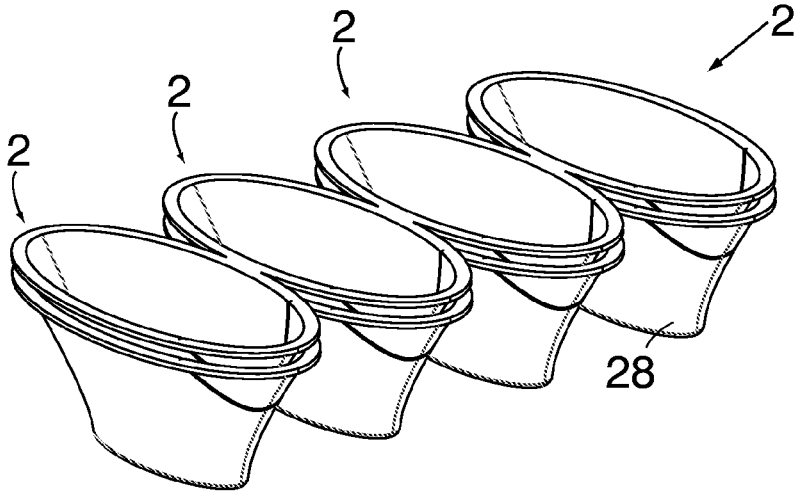
FIG. 12 shows a top perspective view of the embodiment of FIG. 10 showing that the ganged bodies and lid are stackable.
Figure 13:
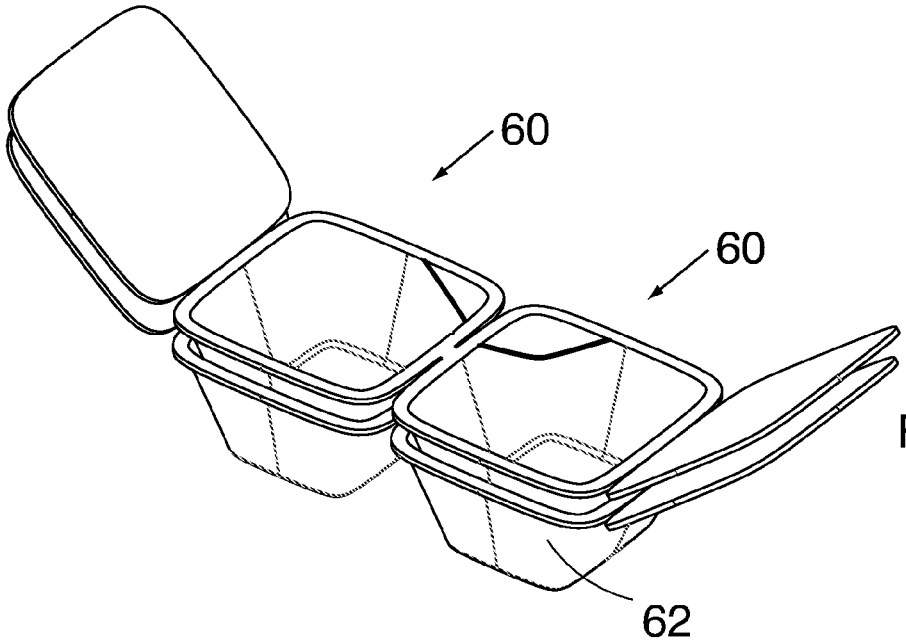
FIG. 13 shows a top perspective view of the embodiment of 8 showing that ganged multiples of the containers are stackable.

FIGS. 12 and 13 show the embodiments of FIGS. 5 and 8*c* in stacks of containers 2, 60. It is desirable that the shape of the body 28, 62 allows for stacking to further ease the manufacture process.

In the embodiments of the invention described above, the covering, body and/or lid may be transparent, semi-transparent or opaque. Transparent or semi-transparent materials allow for precise determination of the amount of contents remaining in the container, or to give a potential consumer confidence with regard to the contents of the container. Measuring or dosage marks may also be provided. Opaque materials allow for the protection of contents from damaging electromagnetic waves such as ultra-violet.

Figure 14A:
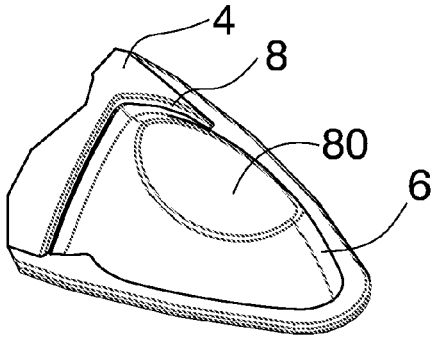
FIGS. 14*a* and 14*b* show a perspective view of a lid connected to a body according to one embodiment the invention, with particular detail of a failure zone.
Figure 14B:
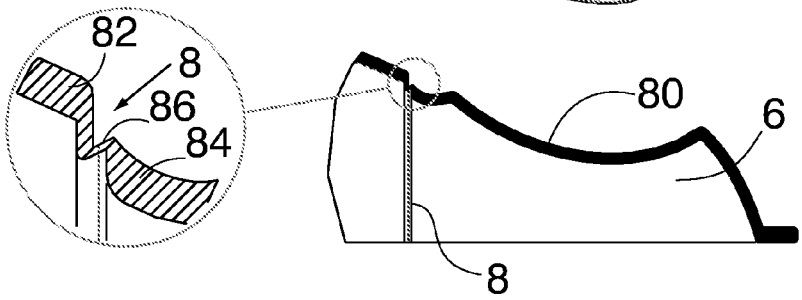

Turning now to FIGS. 14*a*, 14*b* and 15*a* to 15*c*, the lid 6 is shown in greater detail with the failure zone 8 and a thumb or finger placement concave 80. FIG. 14*b* shows a close up of the failure zone 8 which is shown having a body portion 82, a lid portion 84 and a failure portion 86.

Figure 15A:
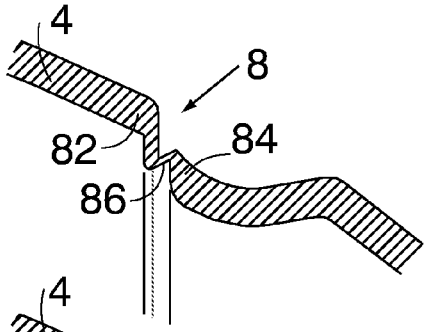
FIGS. 15*a* to 15*c* show a close up of the failure zone of FIG. 14 before and after failure and on re-closing of the lid.

FIG. 15*a* shows the same features in greater detail. FIGS. 14*a* and 14*b* are in a situation where the container is closed, having never been previously opened by the lid 6. Close inspection reveals that the lid portion 84 extends beyond the end of the body portion 82, when viewed perpendicularly from the end of the body portion 82. The failure portion 86, therefore, forms a "Z" like attachment between the body portion 82 and the lid portion 84.

Figure 15B:
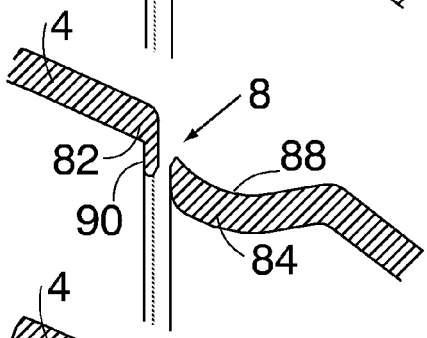

FIG. 15*b* shows the situation where the lid 6 has now been torn away from the body 4 after a person has depressed the lid 6 on the thumb placement concave 80. As can be seen, the failure portion 86 is no longer present. In actual circumstances, the failure portion 86 may be partly attached to either the body portion 82 or the lid portion 84 after the lid 6 has been opened, but for all practical purposes, it is no longer present. The lid 6 can then be hinged back so that the contents of the container can be removed.

Figure 15C:
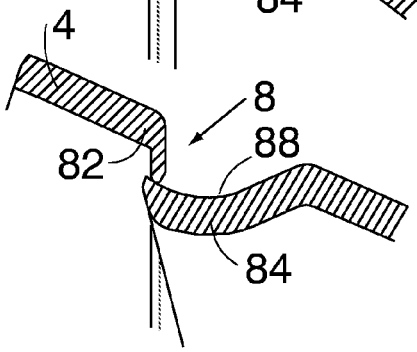

As was established when describing FIG. 15*a*, the lid portion 84 of the failure zone 8 extends beyond the body portion 82. Accordingly, as shown in FIG. 15*c*, pressing the lid 6 back towards the body 4 deforms either or both of the body portion 82 and the lid portion 84 until the lid portion 84 has extended beyond the body portion 82. In this manner, the lid 6 is re-closable.

This concept is further expanded on by incorporating an additional lip 90 extending towards the inside of the container from the body portion 82 and a generally curved surface 88 on the lid portion 84 extending first towards and then away from the inside of the container. The curved surface 88 acts on the lip 90, after being re-closed as in FIG. 15*c*, to further close the lid 6.

The concept of a re-closable lid as described in relation to FIGS. 14*a*, 14*b* and 15*a* to 15*c* is also applicable to containers which do not include a separate covering. For example, a body of generally bottle shape connected to a lid via a connection having a first portion as a failure zone and a second portion as a hinge can be provided.

Contents which may conveniently be dispensed from a dispensing container according to the present invention include, but are not limited to, the following whether in powdered, granulated, liquid or other forms.

Food and beverage products including tea, coffee, sugar, sugar-substitutes and artificial sweeteners, paste, marinade, dried fruit and nuts, milk, drinking additives syrups and powders including hot chocolate, toppings, cordials, alcoholic beverages, confectionary such as sprinkles, chocolates, lollies, salt and pepper, spices, herbs, sauces, dressings, spreads, condiments including soy sauce, mustard, mayonnaise.

Nutraceuticals (for people and animals) including energy & vitamin supplements and concentrates, food supplements, dieting and slimming mixes and powders.

Medicaments, medicines and pharmaceuticals (for people and animals) including drugs, creams, pills, cough syrups, non-prescription medicines such as headache and anti-inflammatory tablets.

Personal care products including toothpaste, mouthwash, floss, hair products and treatments such as shampoos, dyes, hair ties and pins, shaving creams, antiseptics and disinfectants, toothpicks, massage oil, moisturisers, sunscreens, soap and liquid soaps.

Household products including cleaning fluids and detergents, cleansers, furniture oils, bleaches.

Office products including inks, rubber bands, paper clips, staples, drawing pins, nails and tacks, adhesives.

Hardware items including screws, washers, nails, tacks.

Garden and plant products including seeds, fertilizer, poisons, flower booster.

Chemical products for domestic and industrial use, including adhesives and paint products including artists and children's paints, household paint, paint tints, putty fillers.

The container may be manufactured in a wide range of materials, shapes or sizes, according to its required purpose. For example, to dispense orange juice, a rectangular box including a straw could be provided, or alternatively a pyramidal or other three dimensional shape. Suitable shapes include bottles, polyhedral shapes of triangular cross-section. A body of suitable shape could support a covering about which the lid rotates, and the other walls may also be pliable. The advantage of regular, 'stiff' shapes is ease of manufacture, distribution and handling through the distribution chain, while the ability to use pliable materials allows for reduced amounts of "non-natural" materials (such as plastics) to be used, reducing environmental impacts. Depending on the particular application, materials suitable for biostable, biodegradable or food grade applications may be used. Furthermore, in the case of plastic materials, materials suitable for manufacture by injection moulding or blow moulding may be used. A particularly preferable material in which the container may be made is polypropylene.

As the present invention may be embodied in several forms without departing from the spirit of the essential characteristics of the invention, it should be understood that the above described embodiments are not to limit the present invention unless otherwise specified, but rather should be construed broadly within the spirit and scope of the present invention as defined in the appended claims. Various modifications and equivalent arrangements are intended to be included within the spirit and scope of the present invention and appended claims. In particular, variants shown and described can be combined with other variants shown and described, even though those combinations are not specifically shown.

The invention claimed is:

1. A dispensing container comprising:

a body defining a cavity for storing dispensable cavity contents and having an opening which opens into the cavity;

a covering configured to close the opening;

a lid connected to the body by an uninterrupted failure zone and pivotal about a hinge formed at least in part by the covering to cause failure of the failure zone and provide access to the dispensable cavity contents;

a lip and a groove of the failure zone operable, after failure of the failure zone, to effect re-closure of the container, and a lid portion sized and configured to fit at least partially within the body and permit re-closure of the container.

2. The dispensing container of claim 1 wherein the covering is detachable and re-attachable to the body.

3. The dispensing container of claim 1 wherein the covering is contoured.

4. The dispensing container of claim 3 wherein the contoured covering includes a recessed or protruding surface with respect to a plane of the opening and the recessed or protruding surface has a folding element which allows the lid to hinge after failure of the failure zone.

5. The dispensing container of claim 4 wherein the folding element is a notch across the contoured covering at the hinge.

6. The dispensing container of claim 1 wherein the covering includes a first lip snappable over a corresponding feature or features on the body.

7. The dispensing container of claim 1 wherein the body includes at least one gripping element.

8. The dispensing container of claim 1 wherein the body is squeezable, thereby enabling a user to squeeze the dispensing container in order to dispense some or all of the cavity contents.

9. The dispensing container of claim 8 wherein the body includes two or more ridges connected by a resilient or pliable portion and, in use, the squeezing of the two or more ridges encourages egress of the contents from the container.

10. The dispensing container of claim 1 wherein the container includes more than one cavity formed in the body.

11. The dispensing container of claim 1 wherein the failure zone includes a failure portion, a body portion, and the lid portion, wherein in use, after failure of the failure portion, at least one of the body portion and the lid portion is resiliently deformable, whereby the lid portion is engageable with the body portion upon application of a closure force to effect re-closure of the container.

12. The dispensing container of claim 1 wherein the covering includes one or more ribs extending from the covering and being configured to extend into the cavity.

13. A dispensing container comprising:

a body;

a lid connected to the body;

a failure zone in a first portion of the connection between the lid and the body, the failure zone including a failure portion, a body portion, and a lid portion, the failure zone being continuous throughout;

a lip and a curved surface of the body portion and the lid portion of the failure zone, the lip extending inwardly and the curved surface having a concave outer portion that faces outwardly;

a hinge in a second portion of the connection between the lid and the body configured to permit the lid to be moved about the hinge and cause failure of the failure portion wherein in use, after failure of the failure portion, at least one of the body portion and the lid portion is resiliently deformable whereby the lid portion is engageable with the body portion upon application of a closure force to effect re-closure of the container, wherein the lid portion is sized and configured to fit at least partially within the body portion and permit re-closure of the container.

14. A method of manufacturing a dispensing container, the method comprising:

providing a container assembly, the container assembly including:

a body defining a cavity and having an opening which opens into the cavity;

a covering configured to close the opening;

a lid connected to the body by an uninterrupted failure zone and pivotal about a hinge formed at least in part by the covering to cause failure of the failure zone;

a lip and a groove of the failure zone operable, after failure of the failure zone, to effect re-closure of the container; and a lid portion sized and configured to fit at least partially within the body and permit re-closure of the container;

filling the container assembly with contents to be dispensed; and closing the container assembly with the covering.

15. The dispensing container of claim 1 wherein the body has a lower portion configured to rest upon a surface and the body orients the covering to extend obliquely to the surface.

16. The dispensing container of claim 1 further comprising a hinge between the covering and the body.

17. The dispensing container of claim 13 wherein the body includes at least one gripping element.

18. The dispensing container of claim 13 wherein the body includes two or more ridges connected by a resilient or pliable portion and, in use, the squeezing of the two or more ridges encourages egress of the contents from the container.

19. The dispensing container of claim 13 wherein the second portion of the connection between the lid and the body includes a covering.

20. The dispensing container of claim 19 wherein the covering includes one or more ribs extending from the covering and configured to extend into the cavity.

21. The dispensing container of claim 19 wherein the body has a lower portion configured to rest upon a surface and the body orients the covering to extend obliquely to the surface.

22. The dispensing container of claim 19 wherein the covering includes a recessed or protruding surface having a folding element which allows the lid to hinge after failure of the failure portion.

23. The dispensing container of claim 22 wherein the folding element is a notch across the covering at the hinge.

24. The dispensing container of claim 19 further comprising a hinge between the covering and the body.

25. A container assembly comprising a plurality of dispensing containers of claim 1 wherein the bodies of the dispensing containers are connected together.

26. The container assembly of claim 25 wherein the bodies of the dispensing containers include flanges and the bodies of the dispensing containers are connected together at the flanges.

27. A dispensing container comprising:

a body;

a lid connected to the body;

a failure zone in a first portion of the connection between the lid and the body, the failure zone including a failure portion, a body portion, and a lid portion;

a lip and a groove of the body portion and the lid portion of the failure zone operable, after failure of the failure zone, to effect re-closure of the container; and a hinge in a second portion of the connection between the lid and the body configured to permit the lid to be pivoted about the hinge and cause failure of the failure portion, wherein the lid portion is sized and configured to fit at least partially within the body portion and permit re-closure of the container.

28. The dispensing container of claim 27 wherein the failure zone is continuous and free of any openings before the lid has been pivoted about the hinge to cause failure of the failure portion.

29. The dispensing container of claim 27 wherein the second portion of the connection between the lid and the body includes a covering.

* * * * *